United States Patent [19]

Weldle

[11] 4,132,023

[45] Jan. 2, 1979

[54] SELF-LOADING PISTOL

[75] Inventor: Helmut Weldle, Beffendorf, Germany

[73] Assignee: Heckler & Koch GmbH, Oberndorf, Germany

[21] Appl. No.: 798,660

[22] Filed: May 19, 1977

[30] Foreign Application Priority Data

Jun. 19, 1976 [DE] Fed. Rep. of Germany ..... 2627641

[51] Int. Cl.[2] ..... F41C 19/14

[52] U.S. Cl. ..... 42/7; 42/69 A; 89/138

[58] Field of Search ..... 42/7; 89/138, 145

[56] References Cited

U.S. PATENT DOCUMENTS

| | | | |
|---|---|---|---|
| 513,237 | 1/1894 | Kimball | 42/7 |
| 562,455 | 6/1896 | Bye | 42/7 |
| 1,473,571 | 11/1923 | Pedersen | 89/145 |
| 1,569,856 | 1/1926 | Eriksen | 42/7 |

FOREIGN PATENT DOCUMENTS 2242249 3/1974 Fed. Rep. of Germany ..... 42/70 F

OTHER PUBLICATIONS

G. Bock–W. Weigel, Handbuch der Faustfeuerwaffen, Aug. 1971, p. 250.

*Primary Examiner*—Stephen C. Bentley
*Attorney, Agent, or Firm*—Barlow & Barlow

[57] ABSTRACT

A self-loading pistol designed as a grip-cocking type pistol, the grip of which is provided with a cocking lever arranged at the gripfront facing the muzzle of the barrel. Said cocking lever loads an energy accumulator which is released by a trigger and which pushes a striker.

In the cocked position only a minor force is acting on the cocking lever; the energy accumulator is unloaded when the cocking lever reaches its rest position. Not beeing kept by the marksman the pistol always is uncocked. It needs no safety.

14 Claims, 8 Drawing Figures

SELF-LOADING PISTOL

The present invention relates to a self-loading pistol with one barrel and a grip containing a magazine, with a breech block being slidable in the longitudinal direction of the barrel, in which a firing pin is slidably arranged and with energy accumulator means which can be cocked by means of a cocking mechanism and released by means of trigger system, said energy accumulator means providing the percussion energy required for firing a cartridge by means of the firing pin, after being released.

In all known pocket guns the problem arises to reliably prevent the inadvertent going off of a shot, either due to an error of the marksman or due to external effects on the weapon, such as blow or fall, without impairing the constant and as rapid as possible readiness for action of the weapon or the aiming accuracy. In known self-loading pistols with a hammer, the hammer must be cocked before firing the first shot, while the recoiling breech block automatically cocks the hammer for the subsequent shots, respectively. For reasons of safety, the hammer is generally uncocked when carrying the weapon. However, this impairs the rapid readiness for action. Even if a safety mechanism is engaged instead of uncocking the hammer, an essentially more rapid readiness for action is generally not achieved because the safety mechanism must be actuated before shooting, which can easily be forgotten in the excitement of an emergency. In order to achieve an increased safety, on the one hand, and rapid readiness for action, on the other hand, self-loading pistols with double-action triggers have therefore been developped in which energy accumulator means, generally a spring loading the hammer, is cocked by actuating the trigger, whereupon the shot can be fired upon further pulling of the trigger. This offers the advantage that the weapon is constantly ready for action and can be carried when unlocked, with a cartridge being inserted in the barrel without a too high risk that a shot is fired unintentionally. However, a disadvantage is that the first shot to be fired by means of the double-action trigger, due to the trigger force to be applied, is always fired with less accuracy than the subsequent shots for which the hammer has already been cocked by the recoiling breech block. Moreover, it is frequently an annoyance that, in the case of firing with double-action trigger, on the one hand, and with cocked hammer, on the other hand, the point of force application is respectively different. Furthermore, if the weapon is to be carried with the safety released, all these pistols require the hammer to be uncocked after the firing of a shot or after the actuation of the double-action trigger without firing a shot. In this connection care must be taken that a shot is not fired. For uncocking either a safety must first be engaged and then the trigger be actuated or a separate uncocking lever must be actuated. Whereas, in the case of the first possibility there is a considerable risk of error, both possibilities bring about the risk that both steps are forgotten and the weapon is carried while being cocked and the safety being disengaged.

It is the object of the present invention to design a self-loading pistol of the type described at the begining so that a constant readiness for action and a high degree of safety, in particular when carrying the weapon, are simultaneously ensured.

According to the invention this object is achieved by connecting the cocking mechanism to the energy accumulator means in such a manner that the energy accumulator means is constantly unloaded when the cocking mechanism is in the rest position. For this purpose it may be advantageous if the energy accumulator means is not completely unloaded, i.e. if there is a small residual tension, which certainly is not sufficient for firing a shot which, however, on the other hand, results in a defined position of the parts due to the residual tension so that clatering of loose parts is not possible.

A firearm according to the invention the design of which may vary definitely permits carrying, storing and the like in the uncocked condition at any time, because the energy accumulator means is only cocked and a shot can be fired only when the cocking mechanism has been actuated. For example, if the pistol is provided with a double-action trigger it is sufficient to ensure that the energy accumulator means is not caught after cocking and releasable by further pulling of the trigger; there is no catch which is independent of the trigger release. The result is that the energy accumulator means is uncocked upon release of the trigger, irrespective of the fact whether a shot has been fired or not. Alternatively, the design may be such that, although a catch for the energy accumulator means is provided in order to relieve the marksman after cocking of the energy accumulator means, but in this case the catch of the energy accumulator means can be triggered upon release of the cocking mechanism, in particular of the double-action trigger. In addition, if uncocking of the energy accumulator means is to take place only if the returning trigger already approaches its rest position, an energy accumulator means may, for example, be used which, on the one hand, acts on the hammer or the firing pin and which, on the other hand, bears against a movable support. This movable support is moved upon cocking of the energy accumulator means and upon uncocking of the energy accumulator means, whereas for firing a shot with the energy accumulator means being loaded, a detent of the hammer or of the firing pin is triggered and the energy accumulator means thereby moves the hammer or firing pin against the support. In an embodiment of this type with an energy accumulator means which can be shifted in the cocking direction as a whole it can be ensured in a simple manner that the energy accumulator means, with complete safety, is relatively rapidly uncocked only towards the end of the backward motion of the cocking mechanism because this uncocking motion takes place in the opposite direction of the motion for firing a shot.

The design of a self-loading pistol according to the invention becomes particularly simple if the energy accumulator means is retained in the cocked position by the cocking mechanism alone, i. e. if no catch for the energy accumulator means, the hammer or the firing pin is provided. In this connection it must of course be ensured that the cocking device is not an arbitrarily operable member, for example designed as a cocking lever which can be actuated independently of the use or firing of the pistol. On the contrary, it must be ensured that the cocking device can be automatically actuated and automatically released when handling the pistol.

If the energy accumulator means is retained in the cocked position by the cocking mechanism alone, according to a preferred embodiment of the invention, it is expedient to let the trigger system disengage, upon its actuation, from the path of motion of the energy accumulator means, i.e. from a stop position defined by parts of the cocking mechanism.

If the cocking mechanism comprises a trigger which is designed as cocking member, generally the aiming accuracy at least of the first shot is reduced due to the increased trigger force unless a special, non-linear course of the force relative to the trigger motion has been realized, for example by means of a toggle lever arrangement, a cam arrangement or the like. In order to combine the high safety against unintentional firing of a shot when carrying the weapon with the rapid readiness for action of a self-loading pistol with double action trigger, without having to put up with the low aiming accuracy of the first shot, it has become known to design selfloading pistols as grip-cocking type pistols by means of a conversion kit. For this purpose, at the grip back, the side of the grip facing away from the muzzle of the barrel, a cocking lever is provided which enables the hammer spring to be cocked by firmly pressing the pistol grip, said hammer spring being arranged between the magazine housing and the rear narrow side of the grip in conventional pistols. Admittedly, this enables the hammer to be cocked by firmly grasping the weapon so that the first shot can be fired with the same aiming accuracy as the following shots. However, the arrangement of the cocking lever at the grip back where the cocking lever is bearing against the palm of the marksman is disadvantageous from the operational aspect because it is unfavourable from an anatomical point of view. Moreover, in this known weapon the trigger must be actuated for uncocking with the cocking lever being swivelled out, which is very dangerous and, in addition, conflicts with the normal practice of a marksman to actuate the trigger without clasping the grip.

In a preferred embodiment of a self-loading pistol according to the invention which is designed as a grip-cocking type pistol having a cocking lever at the grip, said cocking lever being arranged at the grip front facing the muzzle of the barrel. This arrangement of the cocking lever at the grip front side allows an anatomically correct and hence an easy handling of the pistol by the marksman, because the grip back rests on the palm and cocking is effected by the fingers so that, conversely, the cocking lever must not be pressed by the palm towards the grip. Consequently, the cocking lever is moved in the same direction as the trigger of the weapon, which has been common practice for centuries. This design of a self-loading pistol according to the invention combines the advantage of an increased safety when carrying the weapon with a high readiness for action which has been achieved by omitting the usual safety lever and with the high aiming accuracy already at the first shot. Hence, the weapon according to the invention becomes ready for action by grasping the grip and is uncocked by releasit. Due to the reliable and automatic uncocking upon releasing the grip the weapon has also complete drop safety because owing to the uncocked energy accumulator a shot cannot go off as a result of a hammer detent or the like breaking out. Consequently, inadvertent or intentional carrying of the cocked and possibly unlocked pistol is not only prevented but misoperation which might occur in known self-loading pistols is also precluded because for uncocking without firing a shot a given sequence of grips of specific handling or positioning of the weapon is not required. Moreover, by omitting a separate catch for the energy accumulator means, for example a hammer detent, the drop and shock safety is not only increased but the construction of the weapon is also simplified and its functional safety further increased. A self-loading pistol of this design is therefore not only characterized by a very rapid readiness for action with simultaneous high aiming accuracy already at the first shot, but moreover is also "foolproof". Misoperations and missed engaging or disengaging of the safety are precluded.

The course of the force relative to the path of the cocking member, for example of the cocking lever, may be designed arbitrarily. For example, the use of a non-linear drive means, such as a toggle lever drive or a cam control, may ensure that the force towards the end of the swivel-in motion of the cocking member or cocking lever, i.e. towards the end of the cocking operation, becomes smaller than at the beginning of the cocking operation, to counteract fatigue of the hand during prolonged holding of the pistol in the cocked position. However, in this connection it is still an annoyance that the cocking lever must be held completely swivelled in the cocked position. In preferred embodiments of the invention the cocking mechanism is therefore provided with a releasable catch which becomes effective upon attainment of the cocked position and which automatically disengages upon release. This in an advantageous manner ensures, that after shooting, when cocking the energy accumulator means, the recoiling breech block does not transmit a sudden reaction force to the hand of the marksman. In order to achieve a more unrestricted handling and design of the cocking mechanism, in the preferred embodiment of the invention a drag lever transmits the force acting on the cocking lever upon cocking to the energy accumulator means. For this purpose the automatically engaging and disengaging catch is associated with the drag lever so that in the final phase of the backward movement of the cocking lever it can be released by the same and the energy accumulator means can thus be uncocked. This embodiment of the invention has the advantage that the hand of the marksman is relieved after cocking and that he can hold the pistol with the same force which he would also have to expend for a piston without automatically uncocking energy accumulator means. It is understood that the use of a drag lever is possible, irrespective of the fact whether the pistol is of the grip-cocking or trigger-cocking type. The reaction force exerted by the energy accumulator means is absorbed by the catch for the drag lever. Nevertheless, upon release of the cocking member (cocking lever or trigger) the energy accumulator means is uncocked because in the final phase of the backward movement of the cocking member the catch of the drag lever is released whereupon the energy accumulator means and drag lever can return to their uncocked initial position.

In order to be able to freely design the cocking lever and the drag lever as well as the energy accumulator means, in a preferred embodiment of the invention a transmission lever is arranged between a spring serving as energy accumulator means and the cocking lever or drag lever. While the cocking lever and drag lever are arranged approximately parallel to the front of the grip and hence approximately vertically to the firing direction, the transmission lever may be arranged approximately parallel to the firing direction or at a small angle thereto. Alternatively, if for example the energy accumulator means is designed as a hammer spring extending inside the grip back, the transmission lever can be designed as a toggle lever. However, if the transmission lever is arranged at an acute angle to the firing direction, this has the advantage that the transmission lever extends up to the area of the trigger so that a very simple trigger system can be realized.

The cocking lever and drag lever may be of various designs, for example sliders which are movable parallel to each other. However, preferably the cocking lever and the drag lever are swivelling about an axle which is arranged at the free end of the grip front. For this purpose, in particular, the two levers have a common swivel axle so that a simplified construction is obtained.

Preferably, the arrangement is such that, in the cocked position, the transmission lever immediately catches the energy accumulator means and can be swivelled out by the trigger. Additional parts are not necessary for this purpose.

A particularly simple construction of a self-loading pistol according to the invention is obtained if, according to preferred embodiments, the energy accumulator means immediately acts on the firing pin which has sufficient mass and if, in particular, it is designed as a helical compression spring enclosing the striker. The construction of a hammerless pistol of this type is not only considerably simpler than the construction of a pistol with a hammer because a plurality of complicated individual parts which must be manufactured from material of very high quality with close tolerances is not needed, but the susceptibility of the weapon to faults is also reduced. Moreover, the weapon can be built with smaller dimensions because the complete hammer mechanism is not needed. However, it is particularly advantageous that, due to the omission of a hammer as well as of a hammer mechanism accommodated in the grip area and of a hammer spring, the magazine can be arranged in the grip at a steeper angle, i.e. at an approximately right angle to the firing direction. As a result, the cartridges in the magazine can also be arranged approximately vertically to the longitudinal direction of the magazine so that feeding of the cartridges which, after firing of a shot, and ejection of an empty case automatically takes place within a very short time, can be controlled more effectively and less feed disturbances can occur. A further advantage is that, with a given size of the self-loading pistol, the barrel may be longer by the amount by which the upper end of the magazine can be shifted backward. Thus, with a given ammunition $E_0$ and $v_0$, the aiming accuracy for various distances, the penetration power and the stop power can be increased. Moreover, the grip may extend up to the proximity of the bore axis so that the recoil of the weapon can be more effectively absorbed by the hand of the marksman and the weapon knocks less which is very advantageous when firing a series of shots because the time for realigning the weapon to the aim is reduced after a shot has been fired.

For the interaction between transmission lever and firing pin these parts may be of various designs and matched to one another. Preferably, the firing pin is provided with a lateral nose into the motion path of which an end of the transmission lever is projecting, the trigger being capable of swivelling said end out of the path of motion of the lateral nose. For this purpose the end of the transmission lever projecting into the path of motion of the firing pin nose is provided with an inclined plane along which the nose slides when the bolt stop is recoiling after a shot has been fired and then snaps in whereby the firing pin spring is loaded when the bolt stop again performs a counter-recoil movement. Accordingly, the firing pin in a manner which is known as such, is loaded by a spring in the firing pin direction; during the cocking operation the transmission lever is moved approximately parallel to the bore axis. In this parallel path of motion the transmission lever is non-positively guided, however, the path of motion being laterally positively limited. The effect of the non-positive guidance of the transmission lever and of the inclined plane at the transmission lever (or at the nose) is that the nose swivels the end of the transmission lever out of its path of motion when the breech block and hence firing pin are recoiling and that subsequently the firing pin is caught when the breech block again performs a counter-recoil motion. Therefore, a new cocking operation is not necessary after every shot.

However, without changing the cocking operation of the striker spring, the transmission lever can also be provided with a chamfer without inclined plane if it is ensured that the striker nose or the chamfer has a sufficient length in the firing direction so that the firing pin nose can snap in behind the chamfer but the chamfer cannot snap in behind the firing pin nose. Furthermore, preferably a stop is provided which catches the chamfer of the transmission lever from underneath, with the drag lever being relieved and thereby retains it in the path of motion of the firing pin nose, thus ensuring that the firing can only be moved up to the head of the cartridge case if the drag lever is actuated. In this manner complete security against the release of a shot is achieved if the weapon falls down. Moreover, a resetting spring for the drag lever is not required if, in addition, the arrangement is designed so that the firing pin spring is not completely relieved in the uncocked position and with a residual force presses upon the drag lever and cocking lever via the transmission lever.

Preferably, the firing pin is accommodated in a housing which is secured to the breech block and which is provided with a thrust bottom on its side facing the barrel, said housing containing the firing pin spring. A lateral slot is worked into this housing through which the striker nose projects to the outside.

The firing pin spring transmits a load to the firing pin in a direction towards the thrust bottom. Tensioning of the firing pin spring in this case is not effected during the recoil movement of the breech block, as is usual, but under the influence of a closing spring acting on the breech block during the counter-recoil movement of the breech block because in this case the nose caught from underneath by the transmission lever retains the firing pin, whereas the firing pin housing and the spring bearing with its rear end against said housing are driven forward by the breech block. The closing spring is therefore of an appropriate design. In this connection it is advantageous that a relatively large length is available for the firing pin spring, without the necessity of increasing the length of the weapon or deflecting the spring force. In the case of a pistol designed in this manner, in preferred embodiments of the invention the flux of force between the firing pin spring and the firing pin is interrupted before the firing pin hits the igniter cap of the cartridge and a spring which is weak as compared to the firing pin spring acts on the striker keeping it in a rest position in which the firing pin end is not projecting beyond the thrust bottom. To interrupt the flux of force, a sleeve which can be shifted along the firing pin is provided, said sleeve bearing against the firing pin housing when the firing pin is not yet projecting from the thrust bottom. Coupling between this sleeve, against which the firing pin spring is bearing in the firing direction, and the firing pin is effected by a pin transversely penetrating the firing pin, said pin being guided in an elongated hole in the sleeve, said hole being closed against the firing direction and open in the firing direction.

In pistols with hammers the hammer is generally visible and can be felt. This has the advantage that the marksman can see or feel whether the weapon is cocked or uncocked. In order to provide this advantage also for a pistol designed according to the invention, preferably a member is provided indicating the cocked position when the energy accumulator means is loaded. For this purpose the firing pin itself can be provided with an axial extension which, with the energy accumulator means being loaded, projects from the breech block on the side of the pistol facing away from the muzzle of the barrel. In addition, this projecting part can be colour-marked.

Generally, in self-loading pistols the trigger is linked to a trigger bar which transmits the trigger motion of the trigger and which releases the hammer of the firing pin. In one embodiment of a pistol according to the invention the trigger bar engages one end of the transmission lever from behind which it swivels upon actuation of the trigger. In a pistol according to the invention the trigger system is therefore of a very simple construction which is advantageous for the manufacturing costs, weight and reliability of the weapon.

To prevent that, after the firing of a shot, the next shot goes off immediately when the trigger is further pulled, which is generally undesired with pistols in contrast to submachine guns, for example, an interrupting lever is provided which ensures that the transmission lever does not remain in the swivelled out position obtained by actuating the trigger but that it can again swivel upward into the path of motion of the firing pin nose and can catch the firing pin nose when the breech block performs a counter-recoil movement to reload the energy accumulator means. When the breech block is recoiling the interrupting lever swings the trigger bar, which can be laterally swivelled out against the spring force, away from the zone of engagement of the transmission lever end so that with the trigger being completely pulled and the energy accumulator means being cocked, the trigger bar bears against the front face of the transmission lever end. The next shot can therefore be only fired if the trigger is released inbetween and then again pulled.

In a preferred further embodiment, the interrupting lever being swivelled by the breech block is arranged so that it can be swivelled back by spring force and releases the trigger bar only after the breech block has at least approximately attained its closing position. Thus, the interrupting lever at the same time serves as counter-recoil safety blocking the release of a shot as long as the breech block is for example more than 1.5 mm away from the closing position. This prevents that a shot can be fired when the breech block mechanism is not properly closed, which would endanger the marksman because the rear end of the cartridge is unsupported.

Self-loading pistols are generally provided with a breech block catch lever which is swivelled out by the magazine follower after the last shot and which catches the breech block from underneath, thereby holding it in the open position. Thereupon, after the insertion of a filled magazine, the marksman can close the breech block mechanism by actuating an operating element which swivels the breech block catch lever back again, unless the bolt stop mechanism has not already been closed again by the insertion of the magazine. Due to the function of the breech block catch lever charging of the pistol is not necessary after the insertion of a full magazine so that the re-establishment of the readiness for action is accelerated. Since, in the case of the release of the closing motion of the breech block by the insertion of the magazine, relatively close working tolerances must be kept and since, in the case of the other known embodiments, an additional lever is required in order to swivel the breech block catch lever back and since, in many cases, this lever has an unfavourable position for operation, a more advantageous solution is to be found for a pistol according to the invention. This solution consists in that one end of the breech block catch lever projects into the path of motion of a rocker when the breech block is caught from underneath, said rocker being, in turn, tiltable by the nose of the drag lever so that the bolt stop can be released from its caught position. For this purpose, the rocker is preferably retained in a center position by spring load and of such a design and size that, upon the back-swivel motion of the drag lever, irrespective of the position of the breech block catch lever as well as in the inoperative position of the breech block catch lever, the rocker swings free. On the other hand, by drawing the drag lever the breech block catch lever can be swivelled from its operating position into its rest position so that the breech block becomes free and closes into the cartridge chamber of the barrel while the uppermost cartridge is being introduced. An essential advantage of this arrangement consists in that the solution found is as practical for right-handers as for left-handers.

Further details and embodiments of the present invention, in connection with the claims, will appear from the following description of an embodiment which has been represented in the drawings in a very simplified and schematized manner. In the drawings FIG. 1 shows a center longitudinal section through a self-loading pistol according to the invention, the breech block having been omitted;

Figure 1:
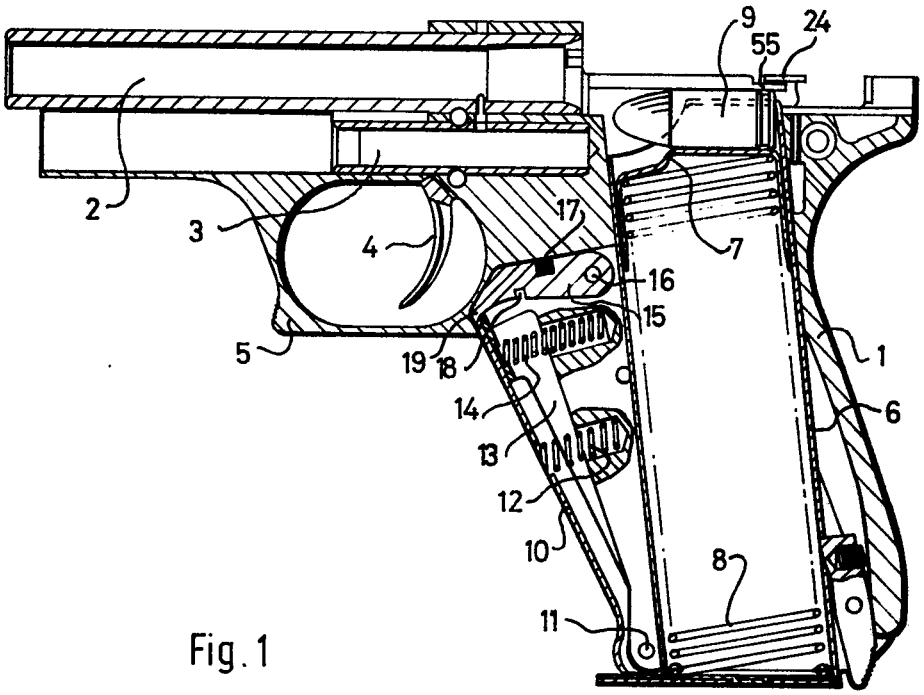

The self-loading pistol represented comprises a grip 1, a barrel 2 attached to grip 1, a gas brake 3 fitted underneath barrel 2, a trigger 4 arranged within a trigger guard 5 which is integral with grip 1 as well as well as a magazine 6 inserted into a magazine housing in grip 1, a magazine follower 7 being slidably guided in said magazine which, under the action of a follower spring 8, presses the respectively uppermost cartridge 9 against magazine lips not represented in the drawing. At the front of grip 1 facing the muzzle of the barrel, in the grip area a cocking lever 10 is arranged underneath the trigger guard 5 to swivel about an axle 11 which is located near the forward lower edge of the grip. The cocking lever 10 is represented in its uncocked rest position in which it is loaded by a spring 12, the end of said cocking lever facing away from axle 11 bearing against a projection of grip 1 in the transition zone between the trigger guard and the grip proper. A drag lever 13 is arranged to swivel about the same axle 11 which, under the action of a resetting spring 14 is in its rest position represented in the drawing. A pawl 15 which is arranged to swivel about an axle 16 and which is accommodated in a recess of grip 1 is loaded by a compression spring 17 which constantly keeps the pawl 15 in contact with the forward edge of the drag lever 13 or of the cocking lever 10. The pawl 15 is provided with a catch groove 18 in which the end of the drag lever 13 engages if it has reached its cocked position. The cocking lever 10 is slightly shorter than the drag lever 13 so that only the drag lever 13 engages in catch groove 18. Upon release of the cocking lever 10 which alone can be directly operated, at the end of its swivel motion, said lever is contacting a projecting nose 19 of pawl 15 so that the latter is raised and the drag lever 13 disengaged from the catch groove 18 and moved back into the prepresented position by its resetting spring 14. The levers have partly flat partly U-shaped or L-shaped cross-sections.

Figure 3:
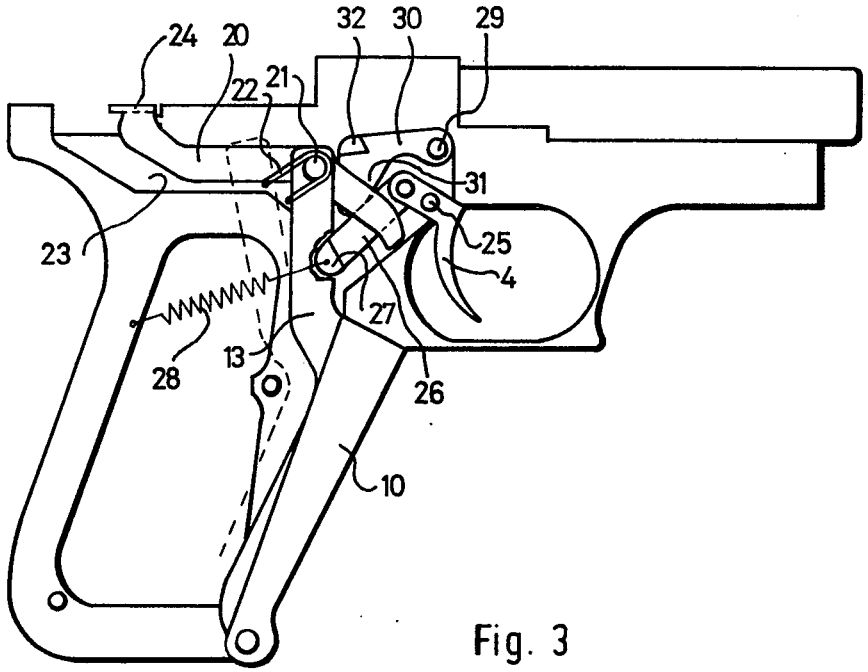
FIG. 3 shows a plan view of the lever system.

Due to the interaction of cocking lever 10, drag lever 13 and pawl 15 the marksman can loosen his hold after the two levers 10 and 13 have been cocked, the cocking lever 10 moving partly backward without affecting the cocked position of the drag lever 13. Not before the cocking lever 10 has at least almost reached its swivelled out rest position, the drag lever 13 also snaps back into its rest position. As can be seen in FIG. 3, the drag lever 13 upwardly extends in the direction toward the bore axis. At this free end a transmission lever 20 is arranged to swivel about an axle 21 and as can be seen from the representation in FIG. 3, said lever is loaded clockwise by a leg spring 22 which, on the one hand, bears against drag lever 13 and, on the other hand, against the side of the transmission lever 20 facing away from the bore axis. Thus, the transmission lever 20 which is accommodated in channel 23 worked into grip 1 bears against the channel edge in the vicinity of the bore axis, unless other forces are acting on said lever. The free end of the transmission lever 20 which consists of a flat strip of material and longitudinally extends at an acute angle to the bore axis, is bent at a right angle. With the drag lever 13 being uncocked, this bent edge 24 is positioned above a stop 55 and thus in that path of motion of firing pin nose 45. The other end of the transmission lever 20 is located in the vicinity of trigger 4 which can be swivelled about a trigger axle 25. The trigger 4 extends into the grip and to the end of this extension a trigger bar 26 is pivoted the free end of which is provided with a trip stop 27. The free end of the trigger bar 26 is loaded by a helical tension spring 28 which keeps the trigger bar 26 approximately in the position represented in FIG. 3.

Approximately halfway between the trigger axle 25 and the bore axis or barrel axis an axle 29 being approximately parallel to the trigger axle 25 is arranged about which a one-armed interrupting lever 30 can be swivelled the free end of which is provided with a downwardly directed nose 31 which, in the rest position, immediately adjoins the center portion of the trigger bar 26, said nose being located in the same plane as the trigger bar. With the breech block mechanism being closed, i.e. if the breech block mechanism is in its forward end position, the interrupting lever 30 is in the position represented in FIG. 3 in which it does not influence the position of the trigger bar 26. The breech block is provided with a projection or an edge which cooperates with the nose 32 located at the free end of the interrupting lever 30 if the breech block is more than a small distance away from the closed position. Due to the cooperation between nose 32 and breech block the interrupting lever 30 is therefore always swivelled towards the trigger bar 26 if the breech block mechanism is insufficiently closed. Due to the swivel motion of the interrupting lever 30 the trigger bar 26 is also swivellled so that the trip stop 27 is disengaged from the neighbouring end of the transmission lever against the action of the helical tension spring 28.

Figure 2:
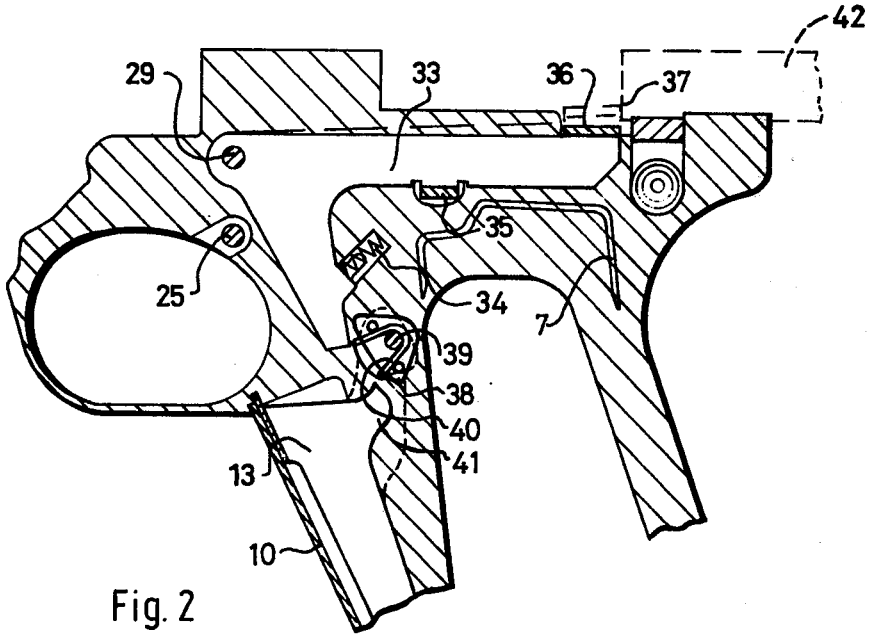
FIG. 2 shows a longitudinal section, the plane of section is parallel to the center plane.

At a shifted position in the axial direction a breech block catch lever 33 (FIG. 2) is arranged to swivel about axle 29. This lever is designed as a toggle lever the longer lever arm of which extends approximately parallel to the bore axis from axle 29 against the firing direction. Its shorter arm extends at an angle of approximately 60° thereto up to the vicinity of the free end of drag lever 13 or cocking lever 10. A resetting spring 34 retains the breech block catch lever 33 in the position represented in FIG. 2 by solid lines. The longer arm of the breech block catch lever 33 which is designed as sheet-metal stamping is provided with a tab 35 bent at a right angle which projects into the path of motion of the follower 7 of magazine 6. The position of tab 35 is such that the follower 7, under the action of the follower spring 8, transmits a force to the breech block catch lever 33 via tab 35 after the last cartridge 9 in magazine 6 has been pushed out. If the breech block 42 which is only represented by dashed lines performs a recoil motion after the last cartridge has been fired, the breech block catch lever 33 moves into the position represented in FIG. 2 by dashed lines so that a bevelled edge 36 provided at the free end of the longer lever arm projects into the path of motion of breech block and the front face of the recoiling breech block bears with an edge 37 against the bevelled edge 36 under the action of a closing spring. Thus, the breech block mechanism remains open after the last cartridge has been fired.

To enable the breech block mechanism to be closed, a rocker 38 is provided which can be swivelled about an axle 39 which, in turn, is arranged in the vicinity of the free ends of the short lever arm of the breech block catch lever 33 or at the free end of the drag lever 13. A leg spring 40 acting on two cams of the rocker 38 keeps the rocker 38 in the position represented in FIG. 2. Upon cocking of the drag lever 13 a nose 41 of drag lever bears against the one end of the rocker 38 and swivels the latter counter-clockwise so that the other end of the rocker presses on the free end of the short lever arm of the breech block catch lever 33 and swivels the latter back into the normal position represented in FIG. 2 by solid lines, the bevelled edge 36 being thereby swivelled out of the path of edge 37 whereupon the closing spring moves the breech block 42 back into the closing position (a cartridge being possibly introduced). The rocker is therefore dimensioned so that, when the breech block catch lever is in the position represented in the drawing by solid lines, the rocker moves past the end of the shorter lever arm and contacts the latter only if it is in the catch position. The end of the rocker 38 engaging the nose 41 of the drag lever 13 is designed so that, respectively towards the end of the swivel-in or swivel-out motion of the drag lever 13 said end is swivelled beyond nose 41 into the center position represented in FIG. 2.

Figure 4:
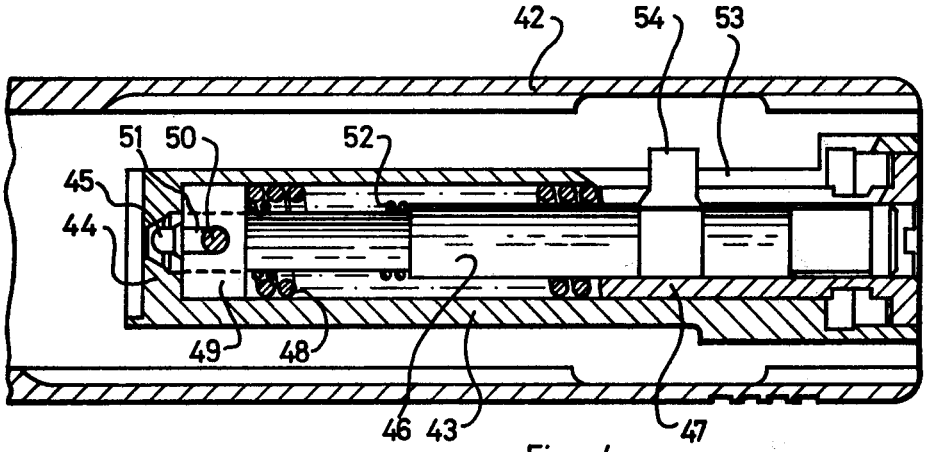
FIG. 4 shows a longitudinal section through the rear end of the breech block, the plane of section being vertical to the longitudinal center plane of the pistol.

In FIG. 4 the rear end of the breech block 42 facing away from the muzzle of the barrel is shown as a sectional view. This rear end provides a housing 43 for a firing pin 45 and its carrier which has the shape of a sleeve the end of which facing the barrel forms a thrust bottom 44 which has a center bore for the passage of the firing pin 45 of carrier 46. In its end portion facing away from the barrel the carrier 46 is guided in a sleeve insert 47 which is located in the housing 43. A carrier spring 48 rests on the forward face of the sleeve insert 47 the forward end of said spring bearing against a sleeve 49. The forward end portion of the carrier 46 is provided with a cross pin 50 which bears against the bottom of an elongated hole 51 in sleeve 49 which is open in the forward direction. The dimensions are such that the firing pin 45 does not project from the thrust bottom 44 in the rest position of the carrier 46, if the cross pin 50 bears against the bottom of the elongated hole 51 and the carrier spring 48 keeps sleeve 49 in contact with the thrust bottom 44. In this position carrier 46 is retained by a resetting spring 52 which, on the one hand, bears against the rear face of sleeve 49 and, on the other hand, against a shoulder of striker 46. The resetting spring 52 is of a much weaker design than the striker spring 48.

A lateral slot 53 is worked into the rear portion of the carrier housing 43 through which a carrier nose 54, which is integral with the carrier 46, projects from the housing 43 into a space which is covered toward the outside by the breech block 42. The bent edge 24 of transmission lever 20 projects into the path of motion of the carrier nose 54.

In case a cartridge is in the barrel after the insertion of a filled magazine 6 and after closing the breech block 42, the cocking lever 10 is depressed into the cocked position by firmly grasping the pistol grip, driving the drag lever 13 until it engages in catch groove 18. During this cocking movement the transmission lever 20 is moved backward away from the barrel and guided in channel 23. The bent edge 24 acts on the carrier nose 54 and drives the carrier backward, the firing pin spring 48 being loaded. Once the cocked position has been reached, the drag lever 13, as has already been described, engages in the catch groove 18 so that the marksman is relieved from the load transmitted from the firing pin spring 48 and resetting spring 14 to the cocking lever 10. By actuating trigger 4 the trigger bar 26 is moved and the trip stop 27 acts on the end of transmission lever 20 so that the latter is swivelled about axle 21 and the bent edge 24 is also swivelled, the carrier nose 54 being released. Thus, the force of carrier spring 48 becomes released and drives the carrier 46 forward, the force being transmitted via sleeve 49 and cross pin 50 until sleeve 49 bears against thrust bottom 44. From this moment carrier 46 which has sufficient mass flies further until the firing pin 45 hits the igniter cap of the cartridge in the barrel through the center bore of thrust bottom 44, thus igniting the cartridge. Upon firing of the shot the gas pressure acts on the cartridge case and drives it backward out of the barrel, the cartridge case moving the breech block 42 backward through the thrust bottom 44. In this case it does not matter whether it is a spring-mass-breech block mechanism, a locked breech block mechanism or a breech block mechanism with gas brake 3. As soon as the breech block 42 has sufficiently recoiled, the case of the fired cartridge is ejected in a known manner and the follower 7 pushes the next cartridge 9 upward against the lips of magazine 6 which are not represented. Subsequently, the breech block 42 performs a counter-recoil movement under the action of the closing spring (not represented in the drawing), the next cartridge being pushed into the barrel in a known manner. In the case of this forward motion the carrier nose 54 bears against the bent edge 24 of the transmission lever 20, the carrier spring 48 being reloaded during the forward motion of the breech block 42. During the recoiling of the breech block 42 the interrupting lever 30 has already been swivelled downward by contacting the nose 32 whereby the trigger bar 26 has also been swivelled and the trip stop 27 has been disengaged from the end of the transmission lever 20. The downward swivel motion of the interrupting lever 30 comes to end only when the breech block 42 is again in the closed position. In case the weapon is not completely closed, i.e. the breech block 42 has not been completely moved forward, the carrier 46 cannot be tripped because the interrupting lever 30 performs the function of a counter-recoil safety. During the recoil movement of breech block 42 the bent edge 24 is below the carrier nose 54; subsequently, the bent edge 24 is swivelled back into the path of the carrier nose 54 under the action of leg spring 22.

For firing the next shot the marksman must release the trigger 4 so that the trip stop 27 which previously was bearing against the front face of the transmission lever 20 again moves behind the end of the transmission lever 20. Thus, upon pulling through of trigger 4 the trip stop 27 can swivel transmission lever so that, as has already been described, the bent edge 24 releases the carrier nose 54 for firing the next shot.

Having thus fully described my invention, what I claim as new and wish to secure by Letters Patent is:

1. A self-loading pistol having a barrel and a grip containing a magazine, a breech block slidable in the longitudinal direction of said barrel, a firing pin slidable in said breech block, energy accumulator means in said breech block to actuate said firing pin, means including a cocking lever to cock and load said accumulator means, stop means to hold said accumulator means in loaded position when said cocking lever is slightly released, trigger means to remove said stop means to permit said accumulator means to unload and act on said firing pin and means to automatically remove said stop means and in turn said cocking means upon complete release of said cocking lever prior to actuation of said trigger means after cocking to unload said accumulator means.

2. The self-loading pistol according to claim 1, which is designed as a cocking-type pistol with a cocking lever being arranged on the front side of the grip facing the muzzle of the barrel, a drag lever transmitting during cocking the mechanical energy from the cocking lever to the energy accumulator means.

3. The self-loading pistol according to claim 2, characterized in that the automatically releasable pawl mechanism arrests the drag lever (13) and that, in the end phase of the return motion of the cocking lever (10), said pawl mechanism can be released (19) by said cocking lever and, consequently, the energy accumulator means (48) can be unloaded.

4. The self-loading pistol according to claim 1, characterized in that a transmission lever (20) is arranged between a spring (48) which serves as energy accumulator means and a cocking lever (10) of the cocking mechanism.

5. The self-loading pistol according to claim 2, characterized in that the cocking lever (10) and drag lever (13) are arranged to swivel about a common axle (11) which is located at the free grip end on the grip front side.

6. The self-loading pistol according to claim 4, characterized in that the transmission lever (20) catches (24)

the energy accumulator means (48) and can be swivelled out by the trigger (4).

7. The self-loading pistol according to claim 2, characterized in that the striker (46) is provided with a lateral striker nose (54) into the path of motion of which a bent edge (24) at the end of the transmission lever (20) is projecting, the trigger (4) being capable of swivelling said bent edge out of the path of motion.

8. The self-loading pistol according to claim 7, characterized in that the bent edge (24) projecting into the path of motion of the striker nose (54) has an inclined plane at the end of the transmission lever (20) along which the striker nose slides and engages behind when the bolt stop performs a recoil movement after a shot has been fired whereby the striker spring (48) is tensioned when the bolt stop (42) again performs a counter-recoil movement.

9. The self-loading pistol according to claim 7, characterized in that the bent edge (24) at the end of the transmission lever (20) projecting into the path of motion of the striker nose (54) or the striker nose has a sufficient length in the firing direction so that the striker nose can only engage behind, but not before the bent edge so that the striker spring (48) is tensioned and the bolt stop again performs a counter-recoil movement after a shot has been fired.

10. The self-loading pistol according to claim 4, having a trigger bar which is pivoted to the trigger, characterized in that the trigger bar (26) moves behind the forward end of the transmission lever (20) and swivels said lever upon actuation of the trigger (4).

11. The self-loading pistol according to claim 10, characterized in that an interrupting lever (30) is provided which can be laterally swivelled out against the spring force when the bolt stop (42) is recoiling and which swivels the trigger bar (26) away from the engagement zone of the end of the transmission lever (20) so that the trigger bar (26) bears against the front face of the forward end of the transmission lever (20) when the trigger (4) is fully pulled and the energy accumulator means (48) is cocked.

12. The self-loading pistol according to claim 11, characterized in that the interrupting lever (30) is arranged so that it can be swivelled back by spring force and releases the trigger bar (26) only if the bolt stop (42) has at least almost reached its closing position.

13. The self-loading pistol according to claim 1, having a bolt stop catch lever which, after the last shot, is swivelled out by the follower of the magazine and catches the bolt stop from underneath, thus retaining it in the open position, characterized in that one end of the bolt stop catch lever (33) projects into the path of motion of a rocker (38) when the bolt stop (42) is caught from underneath, said rocker being, in turn, swivable by nose (41) of the drag lever (13) and the caught position of the bolt stop (42) being thus releasable.

14. The self-loading pistol according to claim 13, characterized in that the rocker (38) is retained in a center position by sp ring load and is of such a design and size that the rocker (38) swings free when the drag lever (13) performs a return swivel motion and the bolt stop catch lever (33) is not in the catch position and that the bolt stop catch lever (33) can be swivelled back from the catch position into its rest position by cocking the drag lever (13).

* * * * *